US009518704B2

(12) United States Patent
Reier

(10) Patent No.: US 9,518,704 B2
(45) Date of Patent: Dec. 13, 2016

(54) LED LAMP WITH AN INTERIOR ELECTRICAL CONNECTION

(71) Applicant: Cree, Inc., Durham, NC (US)

(72) Inventor: Bart P. Reier, Cary, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/189,330

(22) Filed: Feb. 25, 2014

(65) Prior Publication Data

US 2015/0240998 A1 Aug. 27, 2015

(51) Int. Cl.

| | |
|---|---|
| ***F21K 99/00*** | (2016.01) |
| ***F21V 29/503*** | (2015.01) |
| ***F21V 23/06*** | (2006.01) |
| ***F21V 23/00*** | (2015.01) |
| ***F21V 29/00*** | (2015.01) |
| ***F21V 19/00*** | (2006.01) |
| ***F21V 29/77*** | (2015.01) |

(52) U.S. Cl.

CPC . *F21K 9/13* (2013.01); *F21K 9/90* (2013.01); *F21V 19/003* (2013.01); *F21V 23/005* (2013.01); *F21V 29/004* (2013.01); *F21V 29/77* (2015.01)

(58) Field of Classification Search

CPC ..... F21K 9/13; F21K 9/135; F21K 9/1355; F21K 9/137; F21K 9/1375; F21V 29/004; F21V 29/005; F21V 23/004–23/006; F21V 23/009; F21V 23/06; F21V 19/003; F21V 29/503; F21V 29/70; F21V 29/71

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

*Primary Examiner* — Anh Mai
*Assistant Examiner* — Steven Horikoshi
(74) *Attorney, Agent, or Firm* — Dennis J. Williamson; Moore & Van Allen PLLC

(57) ABSTRACT

An LED lamp includes an enclosure and a base. LEDs are mounted on a first portion of a substrate and an electrical contact is mounted on a second portion of the substrate. The LEDs emit light from the enclosure when energized through an electrical path from the base. A heat sink conducts heat to the ambient environment. The first portion of the substrate is mounted on an outside surface of a tower that extends into the enclosure. The second portion of the substrate is located inside of the tower. An extension is electrically coupled to the base and includes a second electrical contact that is electrically coupled to the first electrical contact.

25 Claims, 9 Drawing Sheets

(56) References Cited

U.S. PATENT DOCUMENTS

| | | | | |
|---|---|---|---|---|
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,465,961 | B1 | 10/2002 | Cao | |
| 6,523,978 | B1 | 2/2003 | Huang | |
| 6,550,953 | B1 | 4/2003 | Ichikawa et al. | |
| 6,634,770 | B2 | 10/2003 | Cao | |
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,354,174 | B1 | 4/2008 | Yan | |
| 7,396,142 | B2 | 7/2008 | Laizure, Jr. et al. | |
| 7,600,882 | B1 | 10/2009 | Morejon et al. | |
| 7,726,836 | B2 | 6/2010 | Chen | |
| 7,824,065 | B2 | 11/2010 | Maxik | |
| 7,965,023 | B1 | 6/2011 | Liang | |
| 8,021,025 | B2 | 9/2011 | Lee | |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,249 | B2 | 10/2012 | Liang et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,427,037 | B2 | 4/2013 | Liang et al. | |
| 8,449,154 | B2 | 5/2013 | Uemoto et al. | |
| 8,502,468 | B2 | 8/2013 | Li et al. | |
| 8,556,465 | B2 | 10/2013 | Lee et al. | |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 2004/0201990 | A1 | 10/2004 | Meyer | |
| 2008/0310167 | A1* | 12/2008 | Zaderej et al. | 362/294 |
| 2009/0184618 | A1 | 7/2009 | Hakata et al. | |
| 2010/0073931 | A1* | 3/2010 | Watanabe | F21K 9/00 362/249.02 |
| 2010/0277067 | A1* | 11/2010 | Maxik | F21V 3/00 315/32 |
| 2011/0074290 | A1* | 3/2011 | Sakai | F21K 9/135 315/32 |
| 2011/0140136 | A1* | 6/2011 | Daily | H01R 12/721 257/89 |
| 2011/0234082 | A1* | 9/2011 | Cao | 313/318.01 |
| 2011/0273102 | A1 | 11/2011 | Van De Ven et al. | |
| 2012/0040585 | A1 | 2/2012 | Huang | |
| 2012/0069545 | A1* | 3/2012 | Choi | F21K 9/135 362/84 |
| 2012/0188767 | A1* | 7/2012 | Igaki et al. | 362/249.04 |
| 2012/0268936 | A1* | 10/2012 | Pickard | F21K 9/135 362/249.02 |
| 2013/0026923 | A1 | 1/2013 | Athalye et al. | |
| 2013/0026925 | A1 | 1/2013 | Ven et al. | |
| 2013/0069535 | A1 | 3/2013 | Athalye | |
| 2013/0069547 | A1 | 3/2013 | Van De Ven et al. | |
| 2013/0127353 | A1 | 5/2013 | Athalye et al. | |
| 2013/0128573 | A1* | 5/2013 | Leung | F21V 3/005 362/235 |
| 2013/0162149 | A1 | 6/2013 | Van De Ven et al. | |
| 2013/0162153 | A1 | 6/2013 | Van De Ven et al. | |
| 2013/0169159 | A1 | 7/2013 | Lys | |
| 2013/0170199 | A1 | 7/2013 | Athalye | |
| 2013/0293135 | A1 | 11/2013 | Hu et al. | |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| JP | 2007059930 | A | 3/2007 |
| JP | 2008288183 | A | 11/2008 |
| JP | 2009117346 | A | 5/2009 |
| JP | 3153766 | U | 9/2009 |
| JP | 2009277586 | A | 11/2009 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

* cited by examiner

LED LAMP WITH AN INTERIOR ELECTRICAL CONNECTION

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and/or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature.

SUMMARY OF THE INVENTION

In some embodiments a lamp comprises at least one LED mounted on a submount operable to emit light when energized through an electrical path from the base. A tower comprises an interior and an exterior where at least a first portion of the submount is located on the exterior of the tower. Electrical circuitry is located in the interior of the tower where the submount is electrically coupled to the electrical circuitry in the interior of the tower and the electrical circuitry and the submount are in the electrical path.

The at least one LED may be in an at least partially optically transmissive enclosure. A base may be provided comprising an Edison screw. A second portion of the submount may be located internally of the tower. The second portion may comprise a first electrical contact that is in the electrical path. An extension may extend from the base and may comprise a second electrical contact that is electrically coupled to the first electrical contacts. The submount may comprise one of a flex circuit, MCPCB and a lead frame. The at least one LED may be are mounted on the first portion of the substrate. A plurality of LEDs may be mounted on the first portion of the substrate. One of the first electrical contact and the second electrical contact may be biased into engagement with the other one of the first electrical contact and the second electrical contact. One of the first electrical contact and second electrical contact may be resiliently deformable. The first electrical contact and the second electrical contact may be located internally of the tower. The tower may extend into the enclosure and support the at least one LED at the optical center of the enclosure. A reflector may reflect light from the at least one LED to an exit surface of the enclosure. The base may comprise an Edison screw. The extension may comprise a board where the board supports the lamp electronics in the base. The second electrical contact may be electrically coupled to lamp electronics. The first electrical contact and the second electrical contact may be electrically isolated in the heat sink. The tower may be thermally conductive and may form part of a heat sink for dissipating heat from the at least one LED. The heat sink may comprise a heat dissipating portion that is at least partially exposed to the ambient environment In some embodiments a lamp comprises an at least partially optically transmissive enclosure and a base. A plurality of LEDs are mounted on a submount comprising a first portion on which the plurality of LEDs are mounted and a second portion. The plurality of LEDs are located in the enclosure and are operable to emit light when energized through an electrical path from the base. A heat sink comprises a heat dissipating portion that is at least partially exposed to the ambient environment and a heat conducting portion that is thermally coupled to the plurality of LEDs. The first portion of the submount is mounted on an outside surface of the heat conducting portion and the second portion of the submount is located inside of the heat conducting portion, the second portion of the submount being connected to the electrical path.

A first electrical contact may be mounted on the second portion of the submount and may be in the electrical path, and an extension may be electrically coupled to the base where the extension comprises a second electrical contact that is electrically coupled to the first electrical contact. One of the electrical contact and the second electrical contact may be biased into engagement with the other one of the first electrical contact and the second electrical contact. The one of the electrical contact and the second electrical contact may be resiliently deformable. A reflector may reflect light from the plurality of LEDs to an exit surface of the enclosure. The reflector may comprise a reflective surface that surrounds a portion of the heat sink. The heat sink may be disposed between the enclosure and the base. The base may comprise an Edison screw. The plurality of LEDs may be disposed about the periphery of the heat sink in a band and face outwardly toward the enclosure to create a source of the light that appears as a glowing filament.

DETAILED DESCRIPTION

Figure 1:
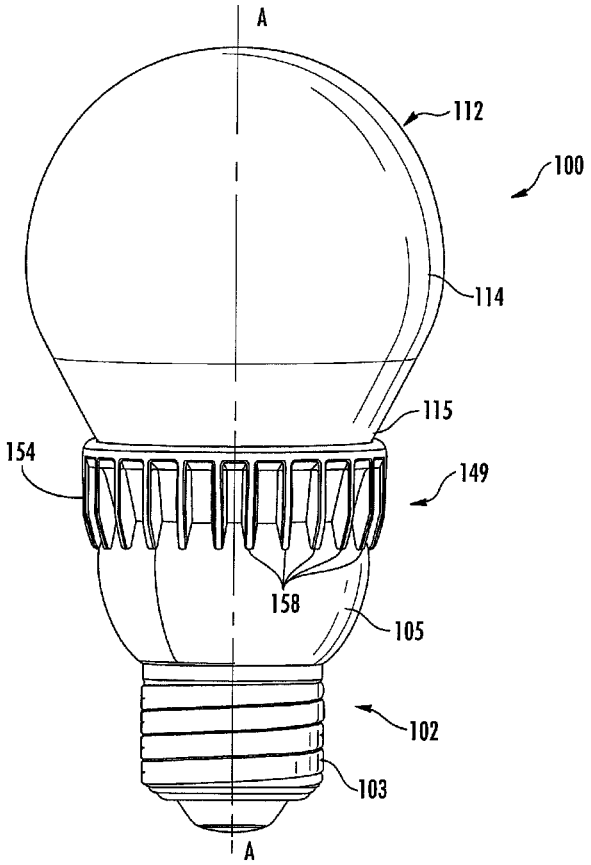
FIG. 1 is a front view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Embodiments of the present invention provide a solid-state lamp with centralized light emitters, more specifically, LEDs. Multiple LEDs can be used together, forming an LED array. The LEDs can be mounted on or fixed within the lamp in various ways. In at least some example embodiments, a submount is used. The LEDs are disposed at or near the center of the enclosure of the lamp. Since the LED array may be configured in some embodiments to reside centrally within the structural enclosure of the lamp, a lamp can be constructed so that the light pattern is not adversely affected by the presence of a heat sink and/or mounting hardware, or by having to locate the LEDs close to the base of the lamp. It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture for mounting on walls, in or on ceilings, on posts, and/or on vehicles.

Figure 2:
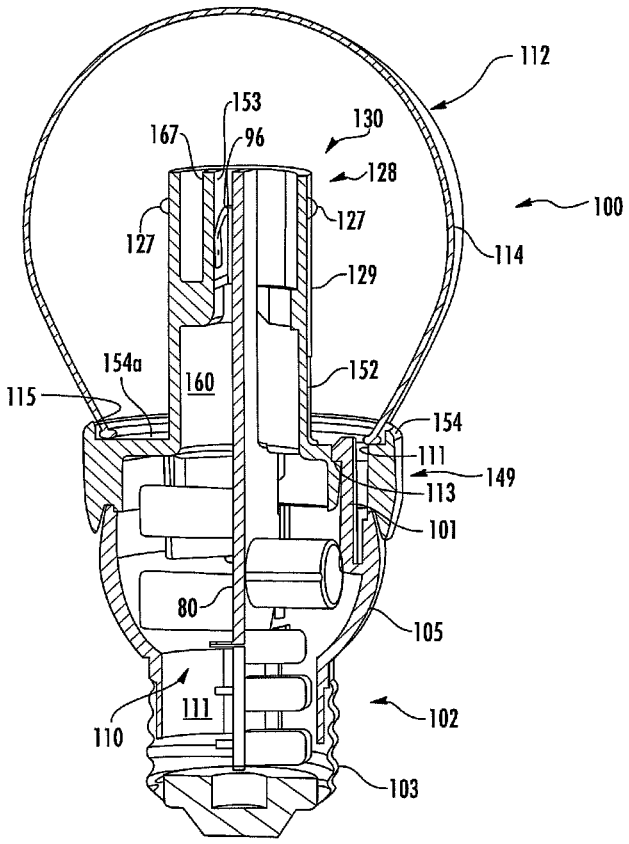
FIG. 2 is a vertical section view of the lamp of FIG. 1.
Figure 3:
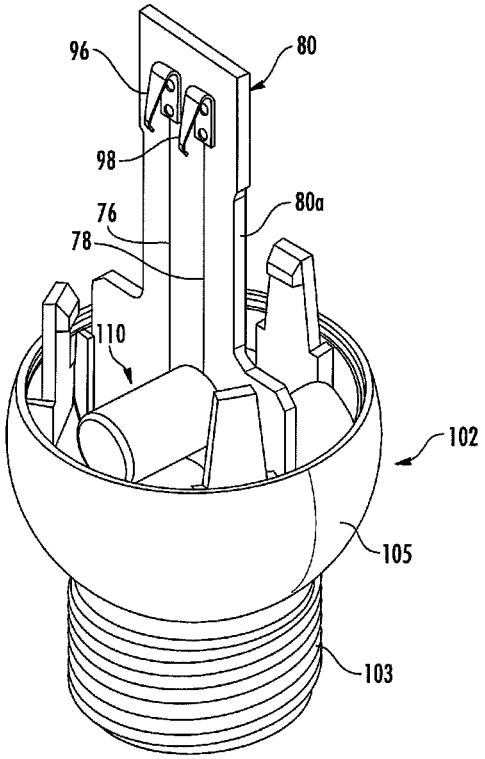
FIG. 3 is a perspective view of the base and lamp electronics of the lamp of FIG. 1.
Figure 4:
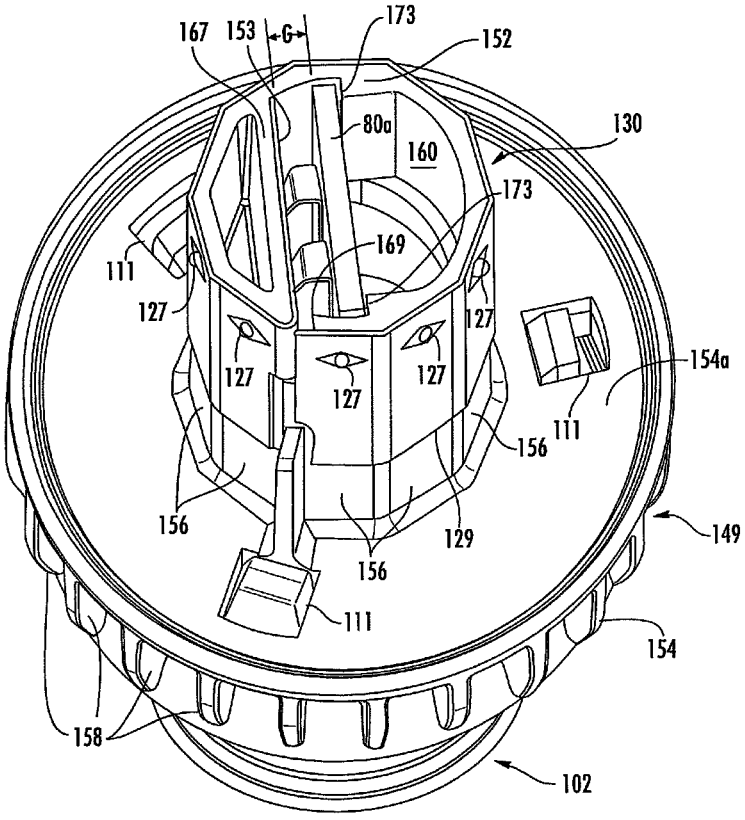
FIG. 4 is a perspective view of the base, heat sink and lamp electronics of the lamp of FIG. 1.
Figure 7:
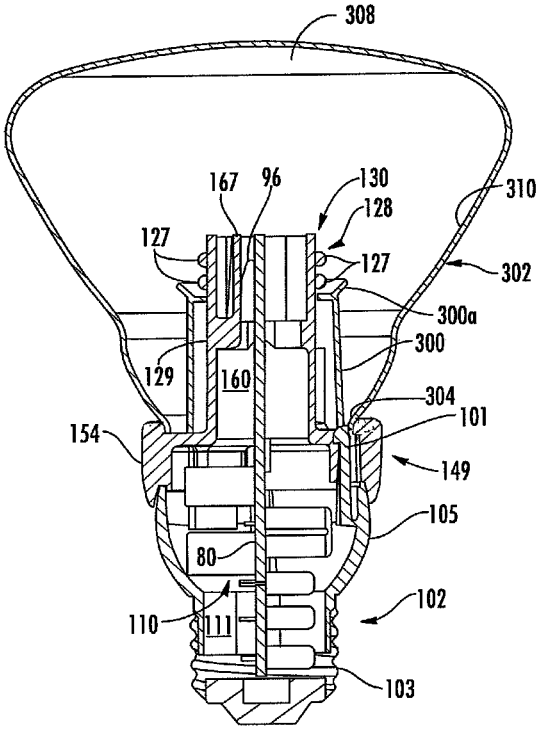
FIG. 7 is a section view similar to FIG. 2 of another embodiment of the lamp of the invention.

FIGS. 1 and 2 show a lamp, 100, according to some embodiments of the present invention. In some embodiments the form factor of the lamp is configured to fit within the existing standard for a lamp. Moreover, in some embodiments the size, shape and form of the LED lamp may be similar to the size, shape and form of traditional incandescent bulbs. Users have become accustomed to incandescent bulbs having particular shapes and sizes such that lamps that do not conform to traditional forms may not be as commercially acceptable. Lamp 100 may be used as an A-series lamp with an Edison base 102, more particularly; lamp 100 is designed to serve as a solid-state replacement for an A series lamp such as an A19, A21, A23 or similar incandescent bulb such that the dimensions of the lamp 100 fall within the ANSI standards for such a bulb. The dimensions may be different for other ANSI standard replacement lamps and/or for non-standard lamps. While a lamp having the size and form factor of a standard-sized household incandescent bulb is shown, the lamp may have other the sizes and form factors. For example, the lamp may be a directional lamp such as a replacement for a PAR-style incandescent bulb such as a PAR-38 incandescent bulb or a BR-style incandescent bulb, an embodiment of which is shown in FIG. 7. The lamp may also be embodied in other standard and non-standard form factors and can have any shape, including standard and non-standard shapes. The LED lamp of the invention is designed to provide desired performance characteristics while having the size, shape and form of a traditional incandescent bulb.

The Edison base 102 as shown and described herein may be implemented through the use of an Edison connector 103 and a housing 105. The LEDs 127 in the LED assembly 130 may comprise an LED die disposed in an encapsulant such as silicone, and LEDs which are encapsulated with a phosphor to provide local wavelength conversion, as will be described later when various options for creating white light are discussed. The LEDs 127 may be mounted on a submount 129 to form an LED array 128 and are operable to emit light when energized through an electrical connection. In the present invention the term "submount" is used to refer to the support structure that supports the individual LEDs or LED packages and in one embodiment comprises a flex circuit although it may comprise other structures.

Enclosure 112 is, in some embodiments, made of glass, quartz, borosilicate, silicate, polycarbonate, other plastic or other suitable material. The enclosure may be of similar shape to that commonly used in household incandescent bulbs. The enclosure 112 is at least partially optically transmissive such that light generated by LEDs 127 may be emitted through the enclosure 112. In a replacement lamp for a standard A-series incandescent bulb the entire enclosure 112 may be optically transmissive. In some embodiments, a glass enclosure is coated on the inside with silica, providing a diffuse scattering layer that produces a more uniform far field pattern. The enclosure may also be etched, frosted or coated. Alternatively, the surface treatment may be omitted and a clear enclosure may be provided. The enclosure may also be provided with a shatter proof or shatter resistant coating. It should also be noted that in this or any of the embodiments shown here, the optically transmissive enclosure or a portion of the optically transmissive enclosure could be coated or impregnated with phosphor or a diffuser. The enclosure 112 may have a traditional bulb shape having a globe shaped main body 114 that tapers to a narrower neck 115 where the neck defines an opening into the enclosure 112.

A lamp base 102 such as an Edison base functions as the electrical connector to connect the lamp 100 to an electrical socket or other connector. Depending on the embodiment, other base configurations are possible to make the electrical connection such as other standard bases or non-standard bases. Base 102 may include the electronics 110 for powering lamp 100 and may include a power supply, including large capacitor and EMI components that are across the input AC line, and/or driver and form all or a portion of the electrical path between the mains and the LEDs. The lamp electronics may be mounted on a board such as printed circuit board (PCB) 80. Base 102 may also include only part of the power supply circuitry while some smaller components reside on the submount 129. With the embodiment of FIG. 1, as with many other embodiments of the invention, the term "electrical path" can be used to refer to the entire electrical path to the LEDs 127, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LED array. Electrical conductors run between the LED assembly 130 and the lamp base 102 to carry both sides of the supply to provide critical current to the LEDs 127 as will be described.

In some embodiments, a driver and/or power supply are included with the LED array 128 on the submount 129. In other embodiments the driver and/or power supply are included in the base 102 as shown. The power supply and drivers may also be mounted separately where components of the power supply are mounted in the base 102 and the driver is mounted with the submount 129 in the enclosure 112. In some embodiments any component that goes directly across the AC input line may be in the base 102 and other components that assist in converting the AC to useful DC may be in the enclosure 112. In one example embodiment, the inductors and capacitor that form part of the EMI filter are in the Edison base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. Other embodiments are possible using different driver configurations. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. With boost technology there is a relatively small power loss when converting from AC to DC. For example, boost technology may be approximately 92% efficient while other power converting technology may be approximately 85% efficient.

Figure 8:
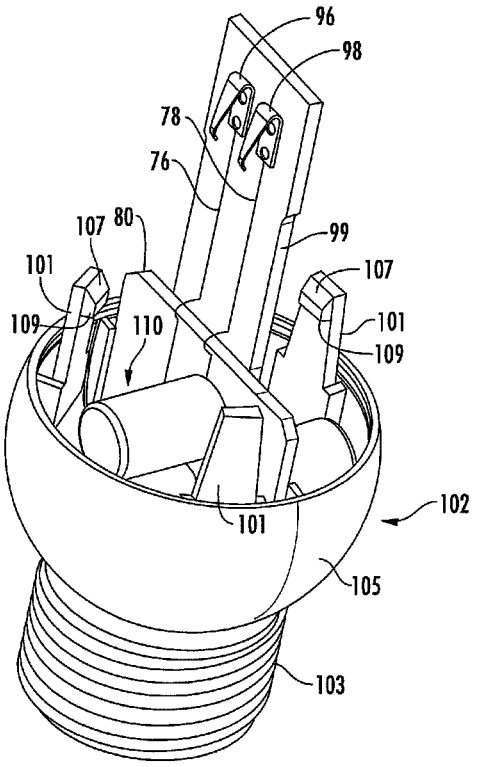
FIG. 8 is a perspective view of the base and lamp electronics similar to FIG. 3 of an alternate embodiment of the lamp of the invention.

The base 102 comprises an electrically conductive Edison screw 103 for connecting to an Edison socket and a housing portion 105 connected to the Edison screw. The Edison screw 103 may be connected to the housing portion 105 by adhesive, mechanical connector, welding, separate fasteners or the like. The housing portion 105 may comprise an electrically insulating material such as plastic. Further, the material of the housing portion 105 may comprise a thermally conductive material such that the housing portion 105 may form part of the heat sink structure for dissipating heat from the lamp 100. The housing portion 105 and the Edison screw 103 define an internal cavity 111 for receiving the electronics 110 of the lamp including the power supply and/or drivers or a portion of the electronics for the lamp. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110. The board 80 comprises a first electrical contact 96 and a second electrical contact 98 that allow the lamp electronics 110 to be electrically coupled to the LED assembly 130 in the lamp as will hereinafter be described. Contacts 96 and 98 may be mounted on printed circuit board 80 which also includes the power supply along with the driver circuitry for the LEDs. The board 80 comprises an extension **80*a* that extends to the outside of the base 102 such that a portion of the board 80 and contacts 96, 98 are exposed beyond the top edge of the base 102. Electrical conductors such as traces 76, 78 may be formed on the board 80 to connect the contacts 96, 98 to the lamp electronics 110. While the contacts 96, 98 are mounted on the PCB 80 that contains the lamp electronics 110, the contacts 96, 98 may be mounted on a separate extension component 99 such as a separate printed circuit board or other support that is fixed to and extends from the base 102 as shown ion FIG. 8. The conductors 76, 78 extend between and electrically couple the contacts 96, 98 on the separate extension component 99 to the lamp electronics 110 on PCB 80. While separate components may be used, mounting the contacts 96, 98 on the extension 80*a* that is formed as one-piece with the PCB 80** may be the most cost effective configuration.

The LED assembly 130 may be implemented using a submount 129 where the submount comprises a flex circuit. The lamp 100 comprises a solid-state lamp comprising a LED assembly 130 with LEDs 127. Multiple LEDs 127 can be used together, forming an LED array 128. The LEDs 127 can be mounted on or fixed within the lamp in various ways. The LEDs 127 in the LED array 128 include LEDs which may comprise an LED die disposed in an encapsulant such as silicone, and LEDs which may be encapsulated with a phosphor to provide local wavelength conversion. A wide variety of LEDs and combinations of LEDs may be used in the LED assembly 130 as described herein. The LEDs 127 of the LED array 128 are operable to emit light when energized through an electrical connection.

The LED assembly 130 comprises a submount 129 arranged such that the LED array 128 is substantially in the center of the enclosure 112 such that the LED's 127 are positioned at the approximate center of enclosure 112. As used herein the terms "center of the enclosure" and "optical center of the enclosure" refers to the vertical position of the LEDs in the enclosure as being aligned with the approximate largest diameter area of the globe shaped main body 114. "Vertical" as used herein means along the longitudinal axis of the bulb where the longitudinal axis extends from the base to the free end of the bulb as represented by line A-A in FIG. 1. In one embodiment, the LED array 128 is arranged in the approximate location that the visible glowing filament is disposed in a standard incandescent bulb. The terms "center of the enclosure" and "optical center of the enclosure" do not necessarily mean the exact center of the enclosure and are used to signify that the LEDs are located along the longitudinal axis of the lamp at a position between the ends of the enclosure near a central portion of the enclosure.

In one embodiment, the LED assembly 130 has a maximum outer dimension that fits into the open neck 115 of the enclosure 112 during the manufacturing process and an internal dimension that is at least as wide as the width or diameter of the heat conducting portion 152 of heat sink 149. In some embodiments the LED assembly 130 and heat sink 149 have a generally cylindrical shape. In other embodiments, the LED assembly 130 can have different cross-sectional shapes, such as triangular, square and/or other polygonal shapes with or without curved surfaces.

Figure 6:
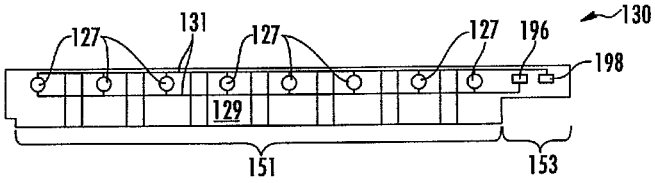
FIG. 6 is a plan view of an embodiment of an LED assembly usable in the lamp of FIG. 1.
Figure 5:
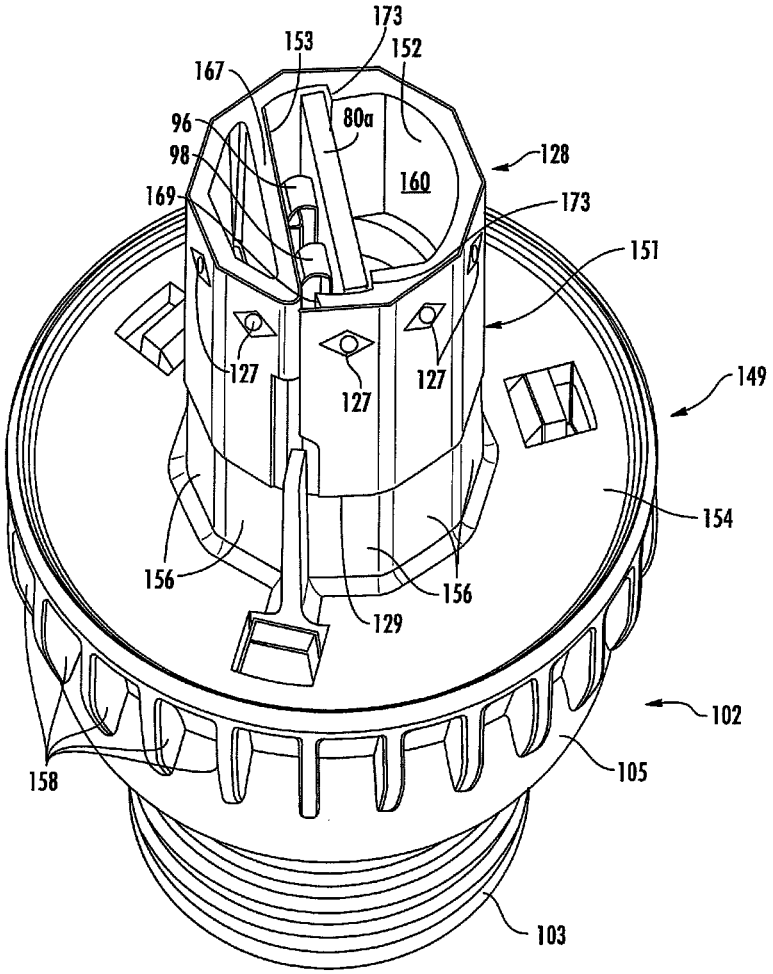
FIG. 5 is another perspective view of the base, heat sink and lamp electronics of the lamp of FIG. 1.

In some embodiments, the submount 129 may comprise a flex circuit. The submount may be made of, or partially made of, a thermally conductive material such that heat generated by the LEDs 127 may be efficiently transferred to the heat sink 149. Referring to FIG. 6, the flex circuit 129 may comprise a first LED mounting portion 151 that functions to mechanically and electrically support the LEDs 127 and a second electrical connector portion 153 that functions to provide the electrical connection to the LED assembly 130. The submount 129 may be bent into the configuration of the LED assembly 130 as shown in the figures. The flex circuit 129 may comprise a flexible layer of a dielectric material such as a polyimide, polyester or other material to which a layer of copper or other electrically conductive material is applied such as by adhesive. Electrical traces 131 are formed in the copper layer to form electrical pads for mounting the electrical components such as LEDs 127 on the flex circuit and for creating the electrical path between the components. The copper layer may be covered by a protective layer or layers. Other embodiments of a flex circuit may also be used. In one embodiment, the exposed surfaces of the submount 129 may be coated with silver or other reflective material to reflect light inside of enclosure 112 during operation of the lamp. The submount may comprise a series of anodes and cathodes arranged in pairs for connection to the LEDs 127. An LED or LED package containing at least one LED 127 is secured to each anode and cathode pair where the LED/LED package spans the anode and cathode. The LEDs/LED packages may be attached to the submount by soldering. In the illustrated embodiments eight pairs, ten pairs and twenty pairs of anodes and cathodes are used for an LED assembly having eight, ten and twenty LEDs 127; however, a greater or fewer number of anode/cathode pairs and LEDs may be used. Moreover, more than one submount 129 may be used to make a single LED assembly 130. For example, two flex circuits 129 may be used to make an LED assembly 130 having twice the number of LEDs as a single flex circuit. The submount 129 may have a variety of shapes, sizes and configurations. The LED assembly 130 further comprises an anode side contact pad 196 and a cathode side contact pad 198 formed on the electrical connector portion 153 of flex circuit 129 that are electrically coupled to the lamp electronics as will be described. The contact pads 196, 198 may be formed as part of the conductive submount 129 on which the LEDs are mounted. For example, the contacts 196, 198 may be formed as part of the electrical traces 131 of the flex circuit or other submount 129.

In some embodiments, the LED lamp 100 is equivalent to a 60 Watt incandescent light bulb. In one embodiment of a 60 Watt equivalent LED bulb, the LED assembly 130 comprises an LED array 128 of 20 XLamp® XT-E High Voltage white LEDs manufactured by Cree, Inc., where each XLamp® XT-E LED has a 46 V forward voltage and includes 16 DA LED chips manufactured by Cree, Inc. and configured in series. The XLamp® XT-E LEDs may be configured in four parallel strings with each string having five LEDs arranged in series, for a total of greater than 200 volts, e.g. about 230 volts, across the LED array 128. In another embodiment of a 60 Watt equivalent LED bulb, 20 XLamp® XT-E LEDs are used where each XT-E has a 12 V forward voltage and includes 16 DA LED chips arranged in four parallel strings of four DA chips arranged in series, for a total of about 240 volts across the LED array 128 in this embodiment. In some embodiments, the LED lamp 100 is equivalent to a 40 Watt incandescent light bulb. In such embodiments, the LED array 128 may comprise 10 XLamp® XT-E LEDs where each XT-E includes 16 DA LED chips configured in series. The 10 46V XLamp® XT-E® LEDs may be configured in two parallel strings where each string has five LEDs arranged in series, for a total of about 230 volts across the LED array 128. In some embodiments eight LEDs may be used, operated at a higher voltage to provide a 40 Watt equivalent LED lamp. In other embodiments, different types and numbers of LEDs are possible, such as XLamp® XB-D LEDs manufactured by Cree, Inc. or others. Other arrangements of chip on board LEDs and LED packages may be used to provide a LED based lamp equivalent to 40, 60 and/or greater other watt incandescent light bulbs, at about the same or different voltages across the LED array 128.

In one embodiment, the flex circuit 129 is formed as a flat member that is bent into a suitable three-dimensional shape such as a cylinder, sphere, polyhedra or the like to form LED assembly 130. Because the flex circuit is made of thin bendable material, and the anodes and cathodes may be positioned on the flex circuit in a wide variety of locations, and the number of LEDs may vary, the flex circuit may be configured such that it may be bent into a wide variety of shapes and configurations.

Figure 9:
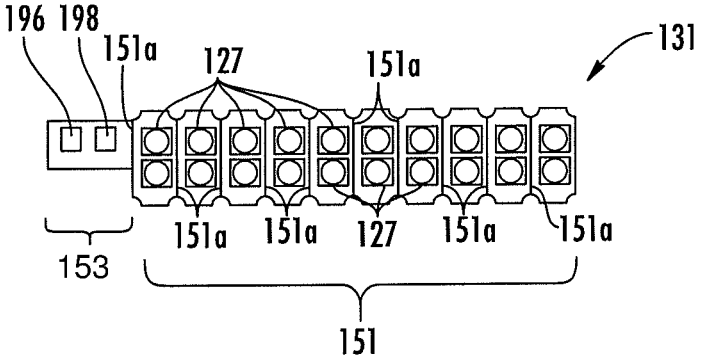
FIG. 9 is a plan view of another embodiment of an LED assembly usable in the lamp of FIG. 1.
Figure 10:
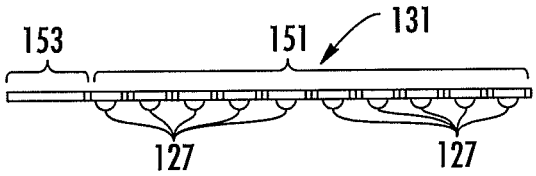
FIG. 10 is a top view of the LED assembly of FIG. 9.

In another embodiment of LED assembly 130 the submount 129 may comprise a metal core board 131 such as a metal core printed circuit board (MCPCB) as shown in FIGS. 9 and 10. The metal core board comprises a thermally and electrically conductive core made of aluminum or other similar pliable metal material. The core is covered by a dielectric material such as polyimide. Metal core boards allow traces to be formed therein. In one method, the core board is formed as a flat member and is bent into a suitable shape such as a cylinder, sphere, polyhedra or the like. Similar to a flex circuit the core board is made of thin bendable material such that it may be bent into a wide variety of shapes and configurations. In one embodiment the core board is formed as a flat member having a first LED mounting portion 151 on which the LEDs/LED packages containing LEDs 127 are mounted. The first portion may be divided into sections by thinned areas or score lines 151*a*. The LEDs/LED packages are located on the sections such that the core board may be bent along the score lines 151*a* to form the planar core board into a variety of three-dimensional shapes where the shape is selected to project a desired light pattern from the lamp 100. An electrical connector portion 153 is formed as part of the MCPCB that comprises the contact pads 196 and 198.

Figure 11:
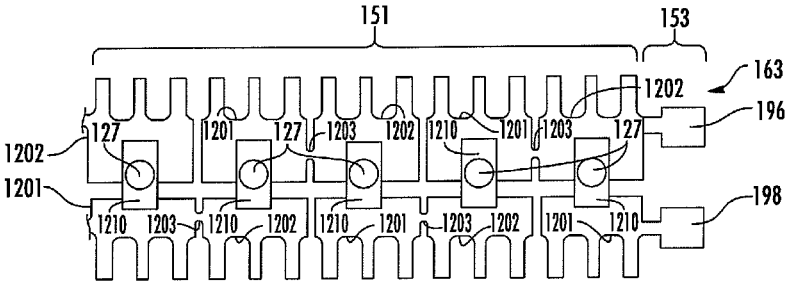
FIG. 11 is a plan view of yet another embodiment of an LED assembly usable in the lamp of FIG. 1.

The submount 129 may also comprise a bendable lead frame 163 made of an electrically conductive material such as copper, copper alloy, aluminum, steel, gold, silver, alloys of such metals, thermally conductive plastic or the like as shown in FIG. 11. In one embodiment, the exposed surfaces of lead frame 163 may be coated with silver or other reflective material to reflect light inside of enclosure 112 during operation of the lamp. The lead frame 163 comprises a series of anodes 1201 and cathodes 1202 arranged in pairs for connection to the LEDs 127. In the illustrated embodiment five pairs of anodes and cathodes are shown for an LED assembly having five LEDs 1127; however, a greater or fewer number of anode/cathode pairs and LEDs may be used. Connectors 1203 connect the anode 1201 from one pair to the cathode 1202 of the adjacent pair to provide the electrical path between the pairs during operation of the LED assembly 130. An LED or LED package containing at least one LED 127 is secured to each anode and cathode pair where the LED/LED package 1210 spans the anode and cathode. The LEDs/LED packages may be attached to the lead frame by soldering. An electrical connector portion 153 is formed as part of the lead frame that comprises the contact pads 196 and 198.

The submount 129 may be bent or folded such that the LEDs 127 provide the desired light pattern in lamp 100. In one embodiment the submount 129 is bent into a generally cylindrical shape as shown in the figures where flat surfaces are created for receiving the LEDs 127. The LEDs 127 are disposed on the flat surfaces of the submount about the axis of the cylinder such that light is projected outward. The LEDs 127 may be arranged around the perimeter of the LED assembly to project light radially.

In some embodiments one of the LEDs 127 may be angled toward the bottom of the LED assembly 130 and another one of the LEDs 127 may be angled toward the top of the LED assembly 130 with the remaining LEDs projecting light radially from a cylindrical LED assembly 13. LEDs typically project light over less than 180 degrees such that angling selected ones of the LEDs ensures that a portion of the light is projected toward the bottom and top of the lamp. The orientations of the LEDs and the number of LEDs may be varied to create a desired light pattern. For example, FIGS. 1-5 show an embodiment of a single tiered LED assembly 130 where a single row of LEDs comprises a series of a plurality of LEDs 127 arranged around the perimeter of the cylinder. While a single tiered LED assembly is shown in FIG. 2 the LED assembly may comprise two tiers of LEDs as shown in FIG. 7, three tiers or additional tiers of LEDs where each tier comprises a plurality of LEDs 127 arranged around the perimeter of the cylinder. The LED array 128 may be shaped other than as a cylinder such as a polyhedron, a helix, double helix, or other shape. In the illustrated embodiments the submount 129 and heat sink 149 are formed to have a generally cylindrical shape; however, the submount and heat sink may have a generally triangular cross-sectional shape, other polygonal shape or even more complex shapes.

The LED assembly 130 may be formed to have any of the configurations shown and described herein or other suitable three-dimensional geometric shape. The LED assembly 130 may be advantageously bent or formed into any suitable three-dimensional shape. A "three-dimensional" LED assembly as used herein and as shown in the drawings means an LED assembly where the submount comprises mounting surfaces for different ones of the LEDs that are in different planes such that the LEDs mounted on those mounting surfaces are also oriented in different planes. In some embodiments the planes are arranged such that the LEDs are disposed over a 360 degree range. The submount may be bent from a flat configuration, where all of the LEDs are mounted in a single plane on a generally planar member, into a three-dimensional shape where different ones of the LEDs and LED mounting surfaces are in different planes.

With respect to the features described above with various example embodiments of a lamp, the features can be combined in various ways. For example, the various methods of including phosphor in the lamp can be combined and any of those methods can be combined with the use of various types of LED arrangements such as bare die vs. encapsulated or packaged LED devices. The embodiments shown herein are examples only, shown and described to be illustrative of various design options for a lamp with an LED array.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light. Such embodiments can produce light with a CRI of at least 70, at least 80, at least 90, or at least 95. By use of the term substantially white light, one could be referring to a chromacity diagram including a blackbody 160 locus of points, where the point for the source falls within four, six or ten MacAdam ellipses of any point in the blackbody 160 locus of points.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

Referring again to the figures, the LED assembly 130 may be mounted to the heat sink structure 149. The heat sink structure 149 comprises a heat conducting portion or tower 152 and a heat dissipating portion 154. In one embodiment the heat sink 149 is made as a one-piece member of a thermally conductive material such as aluminum. The heat sink structure 149 may also be made of multiple components secured together to form the heat sink. Moreover, the heat sink 149 may be made of any thermally conductive material or combinations of thermally conductive materials.

The heat conducting portion 152 is formed as a tower that is dimensioned and configured to make good thermal contact with the LED assembly 130 such that heat generated by the LED assembly 130 may be efficiently transferred to the heat sink 149. In one embodiment, the heat conducting portion 152 comprises a generally cylindrical tower that extends along the longitudinal axis A-A of the lamp and extends into the center of the enclosure 112. The heat conducting portion 152 may comprise generally cylindrical outer surface that matches the generally cylindrical internal surface of the LED assembly 130. In the illustrated embodiment the portions of the submount 129 on which the LEDs 127 are mounted are generally planar. As a result, while the LED assembly 130 is generally cylindrical, the cylinder is comprised of a plurality of planar segments. In one embodiment the heat conducting portion 152 is formed with a plurality of planar facets 156 that abut the planar portions of the submount 129 to provide good surface to surface contact. While the LED assembly 130 and the heat conducting portion 152 are shown as faceted these elements may be curved provided the LEDs may be adequately secured to the submount. Further, while the LED assembly 130 and the heat conducting portion 152 are shown as being generally cylindrical these components may have any configuration provided good thermal conductivity is created between the LED assembly 130 and the heat conducting portion 152. As previously explained, the LED assembly 130 may be formed in a wide variety of shapes such that the heat conducting portion 152 may be formed in a corresponding mating shape. Further, while heat transfer may be most efficiently made by forming the heat conducting portion 152 and the LED assembly 130 with mating complimentary shapes, the shapes of these components may be different provided that sufficient heat is conducted away from the LED assembly 130 that the operation and/or life expectancy of the LEDs are not adversely affected.

The heat conducting portion 152 defines an internal cavity 160 that is dimensioned to receive the extension 80*a*, 99. The internal cavity 160 comprises a first support surface 167 that supports the electrical connection portion 153 of the submount 129 such that the electrical connection portion 153 is supported in a fixed position in the heat conducting portion 152. A slot or aperture 169 is provided in the wall of the heat conducting portion 152 to communicate the interior cavity 160 with the exterior of the heat conducting portion 152. The aperture 169 is positioned adjacent the support surface 167. In one embodiment the electrical conductor portion 153 of the LED submount 129 is inserted into the aperture 169 such that the contact pads 196 and 198 are located inside of the heat conducting portion 152 and are exposed to the interior of the heat conducting portion 152. The back surface of the electrical connection portion 153 abuts against the support surface 167. The LED mounting portion 151 of the LED submount 129 wraps around and closely engages the outer periphery of the heat conducting portion 152.

The submount 129 is mounted on the heat conducting portion 152 by forming the submount 129 to have a mating complimentary shape to the exterior surface of the heat conducting portion 152. The LED mounting portion 151 is positioned on the exterior of the heat conducting portion 152 such that the LEDs 127 face outwardly. In one embodiment the flat faces 156 of the heat conducting portion 152 support the flat faces of the submount 129 such that good surface-to-surface contact is provided between the submount and the heat conducting portion 152 to provide good heat transfer from the LED assembly to the heat conducting portion 152. The LED assembly 130 may be mounted directly to the heat conducting portion 152 or intervening components may be disposed between the LED assembly 130 and the heat conducting portion 152 provided that the intervening components provide efficient heat transfer of the heat generated by the LEDs 127 to the heat conducting portion 152. In some embodiments, a variety of connection mechanisms including thermally conductive pressure sensitive adhesive, thermal epoxy, thermal grease in combination with a mechanical retention clip or compression band may be used between the LED submount 129 and the heat conducting portion 152 to secure the LED assembly 130 to the heat conducting portion 152. In other embodiments mechanical connectors may be used to secure the LED assembly to the heat conducting portion 152.

The heat dissipating portion 154 is in thermally coupled to the heat conducting portion 152 such that heat conducted away from the LED assembly 130 by the heat conducting portion 152 may be efficiently dissipated from the lamp 100 by the heat dissipating portion 154. In one embodiment the heat conducting portion 152 and heat dissipating portion 154 are formed as one-piece. The heat dissipating portion 154 extends to the exterior of the lamp 100 such that heat may be dissipated from the lamp to the ambient environment. In one embodiment the heat dissipating portion 154 is formed generally as a disk where the distal edge of the heat dissipating portion 154 extends outside of the lamp and forms an annular ring that sits on top of the open end of the base 102. A plurality of heat dissipating members 158 may be formed on the exposed portion to facilitate the heat transfer to the ambient environment. In one embodiment, the heat dissipating members 158 comprise a plurality fins that extend outwardly to increase the surface area of the heat dissipating portion 154. The heat dissipating portion 154 and heat dissipating members 158 may have any suitable shape and configuration. Different embodiments of the LED assembly and heat sink tower are possible. In various embodiments, the LED assembly may be relatively shorter, longer, wider or thinner than that shown in the illustrated embodiment. In some embodiments the tower 152 may be made of a thermally non-conductive material such as plastic where the heat conducting portion of the heat sink 149 is formed as a separate component from the tower. In such an embodiment the tower may be mounted on the heat dissipating portion 154 or it may be mounted to another component of the lamp such as to the base 102. In embodiments where the tower is not thermally conductive the heat dissipating portion 154 may be connected directly to the LED assembly or other heat conducting elements such as thermally conductive members, e.g. aluminum rods, may be disposed between the LED assembly and the heat dissipating portion where the tower does not form part of the thermal path between the LED assembly and the heat dissipating portion.

To provide the electrical connection between the LED assembly 130 and the lamp electronics 110, the extension 80*a*, 99 is positioned in the interior cavity 160 of the heat conducting portion 152 of the heat sink 149. A portion of the extension 80*a*, 99 is disposed opposite to the electrical connector portion 153 of the submount 129 that comprises the anode side contact pad 196 and a cathode side contact pad 198. The electrical contacts 96 and 98 are mounted on the board 80 in a position opposite to the electrical contact pads 196, 198 on the submount 129 such that when the board 80 is inserted into the heat conducting portion 152 the contacts 96 and 98 are disposed opposite to and contact the pads 196 and 198 formed on the flex circuit to complete the electrical path between the electronics 110 on the PCB 80 and the LED assembly 130. Electrical conductors 76, 78 such as traces are formed on the extension 80*a*, 99 or otherwise provided between the lamp electronics 110 and the contacts 96, 98.

In one embodiment the contacts 96, 98 are resilient members that deformably engage the contact pads 196, 198 formed on the flex circuit 129 such that the resiliency of the contacts 96, 98 biases the contacts 96, 98 into engagement with the pads 196, 198. While the deformable resilient contacts 96, 98 are shown as being mounted on the board 80 the parts may be reversed such that the deformable resilient contacts are on the LED submount 129 and the pads 96, 98 are on the extension 80*a*, 99. Moreover, the biasing force may be created using a separate biasing mechanism rather than using the resiliency of the contacts 96, 98.

The electrical connector portion 153 of the submount 129 is disposed against the internal support surface 167 of the heat sink 149 such that the contact pads 196, 198 are supported in a fixed position. The back of the extension 80*a*, 99 (the back being the side of the extension opposite to the contacts 96, 98) abuts internal support surfaces 173 inside of the heat conducting portion 152 such that the extension 80*a*, 99 is also held in a fixed position in the heat conducting portion 152. The distance between the support surface 167 and the support surfaces 173 defines a gap G between the extension 80*a*, 99 and the electrical connector portion 153 of submount 129. The width of the gap G is selected to deform the contacts 96, 98 a determined mount where the deformation of the contacts generates a desired bias force between the contacts 96, 98 and the pads 196, 198 sufficient to create a good electrical connection between these components. The live electrical components are located inside of the heat conducting portion 152 such that the live electrical components are contained within the heat conducting portion 152 and are isolated from the external environment.

Standards may require that in the event the enclosure 112 is broken or shattered a person cannot contact live electrical components that may be exposed on the interior of the lamp. In some embodiments a safety coating may be applied to the enclosure to prevent the enclosure from shattering. The shatter proof or shatter resistant coating functions to hold the shattered enclosure pieces together such that access to the internal electrical components is prevented even if the rigid (e.g. glass or plastic) enclosure is broken. In some embodiments it may be desirable to eliminate the shatter proof/resistant coating to eliminate processing steps, associated costs and/or the like. In some embodiments locating the electrical contacts in the internal space of the heat conducting portion 152 of heat sink 149 may eliminate the need for the shatter proof/resistant coating. The shatter proof/resistant coating may also be used in addition to isolating the electrical components.

The size of the gap G is selected such that the live electrical components, such as contacts 96, 98 and pads 196,198 are safely isolated from a user in the event of enclosure failure. Typical standards specify a maximum allowable gap or opening size through which electrical components are accessible. The gap or opening size is small enough that that a user's finger is prevented from contacting live electrical components. In the lamp of the invention the width of gap G may be selected to be smaller or the same size as the specified maximum of the appropriate standard. In some embodiments, the top of the heat conducting portion 152 may be closed or covered by an additional cover piece such that the electrical contacts located in internal space 160 are completely isolated from a user in the event that the enclosure 112 fails.

To mount the LED assembly 130 on the heat sink 149, the heat conducting portion 152 of heat sink 149 is inserted into the LED assembly 130, or the LED assembly is wrapped around the heat conducting portion 152, such that the LED assembly 130 surrounds and contacts the heat conducting portion 152 such that the heat sink and LED assembly are thermally coupled. The electrical connection portion 153 of the submount 129 is inserted through aperture 169 such that the electrical connector portion 153 is located in the internal space 160. Contact pads 196, 198 are positioned in the internal space 160 where they are accessible from the interior of the heat sink. The electrical connector portion of the flex circuit is backed and supported by support surface 167.

The contacts 96, 98 are arranged on the extension 80*a*, 99 such that as the extension 80*a*, 99 is inserted into the heat conducting portion 152 the contacts 96, 98 are slightly deformed as they are compressed between the extension 80*a*, 99 and the submount 129. The support surfaces 173 guide the extension 80*a*, 99 into position and maintain the position of the extension 80*a*, 99 relative to the LED assembly 130 such that the contacts 96, 98 remain resiliently deformed in the space between the board and the LED assembly. Because the contacts 96, 98 are resilient, a bias force is created that biases the contacts 96, 98 into engagement with the LED assembly 130 contact pads 196, 198 to ensure a good electrical coupling between the contacts 96, 98 and the LED assembly 130. The engagement between the contacts 96, 98 and the and the anode side and the cathode side contact pads 196, 198 of the LED assembly 130 is referred to herein as a contact coupling where the electrical coupling is created by the contact under pressure between the contacts 96, 98 and pads 196, 198, as distinguished from a soldered coupling.

To secure the base 102 to the heat sink 149, first engagement members on the base 102 may engage mating second engagement members on the heat sink structure 149. In one embodiment, the first engagement members comprise deformable resilient fingers 101 that comprise a camming surface 107 and a lock member 109. The second engagement member comprises apertures 111 formed in the heat sink 149 that are dimensioned to receive the fingers 101. In one embodiment, the housing 105 of the base 102 is provided with fingers 101 that extend from the base 102 toward the heat sink 149. In the illustrated embodiment three fingers 101 are provided although a greater or fewer number of fingers may be provided. The fingers 101 may be made as one-piece with the housing 105. For example, the housing 105 and fingers 101 may be molded of plastic. The apertures 111 define fixed members 113 that may be engaged by the lock members 109 to lock the fingers 101 to the heat sink 149. The base 102 may be moved toward the bottom of the heat sink 149 such that fingers 101 are inserted into apertures 111 and the camming surfaces 107 of the fingers 101 contact the fixed members 113. The engagement of the fixed members 113 with the camming surfaces 107 deforms the fingers 101 to allow the locking members 109 to move past the fixed members 113. As the lock members 109 pass the fixed members 113 the fingers 101 return toward their undeformed state such that the lock members 109 are disposed behind the fixed members 113. The engagement of the lock members 109 with the fixed members 113 fixes the base 102 to the heat sink 149. The snap-fit connection allows the base 102 to be fixed to the heat sink 149 in a simple insertion operation without the need for any additional connection mechanisms, tools or assembly steps. While one embodiment of the snap-fit connection is shown numerous changes may be made. For example, the deformable members such as fingers may be formed on the heat sink 149 and the fixed members such as apertures may be formed on the base 102. Moreover, both engagement members may be deformable. Further, rather than using a snap-fit connection, the electrical interconnect 150 may be fixed to the heat sink using other connection mechanisms such as a bayonet connection, screwthreads, friction fit, adhesive, mechanical connectors or the like.

During the mounting of the base to the heat sink, as the base 102 is brought into engagement with the heat sink 149, the extension 80*a*, 99 is simultaneously inserted into the heat conducting portion 152. As the extension 80*a*, 99 is inserted into the heat sink 149, the contacts 96, 98 are moved into electrical contact with the contact pads 196, 198 to complete the electrical path between the base 102 and the LED assembly 130 as previously described.

The enclosure 112 may be attached to the heat sink 149. In one embodiment, the LED assembly 130 and the heat conducting portion 152 are inserted into the enclosure 112 through the neck 115. The neck 115 and heat sink dissipation portion 154 are dimensioned and configured such that the rim of the enclosure 112 sits on the upper surface 154*a* of the heat dissipation portion 154 with the heat dissipation portion 154 disposed at least partially outside of the enclosure 112, between the enclosure 112 and the base 102. To secure these components together a bead of adhesive may be applied to the upper surface 154*a* of the heat dissipation portion 154. The rim of the enclosure 112 may be brought into contact with the bead of adhesive to secure the enclosure 112 to the heat sink 149 and complete the lamp assembly. In addition to securing the enclosure 112 to the heat sink 149 the adhesive may be deposited over the snap-fit connection formed by fingers 101 and apertures 111. The adhesive flows into the snap fit connection to permanently secure the heat sink to the base.

In the lamp of the invention, the LEDs 127 are arranged at or near the optical center of the enclosure 112 in order to efficiently transmit the lumen output of the LED assembly through the enclosure 112. The most efficient transmission of light through a transparent or semitransparent surface is when the light incident to the surface is normal to the surface. For example, if the enclosure is a perfect sphere, an omnidirectional light source located at the center of the sphere provides the most efficient transmission of light through the enclosure because the light is normal to the surface of the enclosure at all points on the sphere's surface. In the lamp of the invention the LEDs 127 are arranged at or near the optical center of the enclosure 112 to maximize the amount of light that is normal to the surface of enclosure 112. While all of the light emitted from LEDs 127 is not normal to the enclosure 112, with the LED assembly positioned at or near the optical center of the enclosure more of the light is normal to the enclosure than in solid state lamps where the light source is located near the base of the enclosure or is otherwise located such that a large portion of the light is incident on the enclosure at other than right angles. By facing the LEDs 127 outwardly, the LEDs emit light in a generally hemispherical pattern that maximizes the amount of light that is normal to the enclosure 112. Thus, the arrangement of the outwardly facing LEDs at or near the optical center of the enclosure, as shown in the figures, provides efficient transmission of the light through the enclosure 112 to increase the overall efficiency of the lamp.

FIG. 7 shows an embodiment of a lamp that uses the LED assembly 130, heat sink with the tower arrangement 149, and electrical connection as previously described in a directional lamp such as a replacement for a BR or a PAR style bulb. The previous embodiments of a lamp refer more specifically to an omnidirectional lamp such as an A series replacement bulb. In the BR or PAR lamp the light is emitted in a directional pattern rather than in an omnidirectional pattern. Standard BR type bulbs are reflector bulbs that reflect light in a directional pattern; however, the beam angle is not tightly controlled and may be up to about 90-100 degrees or other fairly wide angles. In a PAR type lamp the light is also emitted in a directional pattern. Standard PAR bulbs are reflector bulbs that reflect light in a direction where the beam angle is tightly controlled using a parabolic reflector. PAR lamps may direct the light in a pattern having a tightly controlled beam angle such as, but not limited to, 10°, 25° and 40°. The bulb shown in FIG. 22 is a directional lamp and may be used as a solid state replacement for such a reflector type BR and/or PAR bulb or other similar bulbs.

The lamp comprises a base 102, heat sink 149, LED assembly 130 and electrical connection as previously described. As previously explained, the LED assembly 130 generates an omnidirectional light pattern. To create a directional light pattern, a primary reflector 300 is provided that reflects light generated by the LED assembly 130 generally in a direction along the axis of the lamp. Where the lamp is intended to be used as a replacement for a BR type lamp the reflector 300 may reflect the light in a generally wide beam angle and may have a beam angle of up to approximately 90-100 degrees. As a result, the reflector 300 may comprise a variety of shapes and sizes provided that light reflecting off of the reflector 300 is reflected generally along the axis of the lamp. The reflector 300 may, for example, be conical, parabolic, hemispherical, faceted or the like. In some embodiments, the reflector may be a diffuse or Lambertian reflector and may be made of a white highly reflective material such as injection molded plastic, white optics, PET, MCPET, or other reflective materials. The reflector may reflect light but also allow some light to pass through it. The reflector 300 may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet.

The reflector 300 is mounted in the lamp such that it surrounds the LED assembly 130 and reflects some of the light generated by the LED assembly. In some embodiments, the reflector 300 reflects at least 20% of the light generated by the LED assembly. In other embodiments, the reflector 300 reflects about at least 40% of the light generated by the LED assembly 130 and in other embodiments, the reflector 300 may reflect about at least 60% of the light generated by the LED assembly 130. Because the reflector 300 may be at least 95% reflective, the more light that hits the reflector 300 the more efficient the lamp. This is in contrast to the reflective aluminum coating typically found on a standard BR lamp enclosure that is approximately 80% reflective.

The reflector 300 may be mounted on the heat sink 149 or LED assembly 130 using a variety of connection mechanisms. In one embodiment, the reflector 300 is mounted on the heat conducting portion or tower 152 of the heat sink 149. The reflector may also be mounted on the heat dissipating portion 154 of the heat sink 149 or to enclosure 302. The reflector 300 may be mounted to the heat sink 149 or LED assembly 130 using separate fasteners, adhesive, friction fit, mechanical engagement such as a snap-fit connection, welding or the like. In one embodiment, the reflector 300 is made in two portions that together surround the heat conducting portion or tower 152 and connect to one another using snap fit connectors to clamp the heat sink therebetween. The reflector 300 is dimensioned such that the LED assembly 130, heat sink 149 and reflector 300 may be inserted through the opening 304 in the neck of enclosure 302. The LED assembly 130, heat sink 149 and reflector 300 are inserted into the enclosure 302. The enclosure 302 may be secured to the heat sink 149 as previously described using adhesive or other connection mechanism.

The enclosure 302 is typically coated on an interior surface with a highly reflective material such as aluminum to create a reflective surface 310 and an optically transmissive exit surface 308 through which the light exits the lamp. The exit surface 308 may be frosted or otherwise treated with a light diffuser material. As previously explained, the reflector 300 may be positioned such that it reflects some of the light generated by the LED assembly 130. However, at least a portion of the light generated by the LED assembly 130 may not be reflected by the reflector 300. At least some of this light may be reflected by the reflective surface 310 of the enclosure 302. Some of the light generated by the LED assembly 130 may also be projected directly out of the exit surface 308 without being reflected by the primary reflector 300 or the reflective surface 310. The reflective surface 310 is shaped to provide the desired light pattern such that light is reflected from surface 310 and emitted from the lamp at a desired beam angle. IN a BR-style lamp where the beam angle may not be tightly controlled the surface 310 may have any suitable shape. In a PAR style bulb the reflective surface 300*a* of the reflector 300 may be formed as a parabola to create a narrower beam. Moreover, the reflective surface 310 of the enclosure 302 may be shaped such as a parabolic reflector to obtain the desired narrow beam.

While the reflective surface 300*a* is shown as being arranged closely adjacent to the LED assembly 300, the reflector may be arranged such that the reflective surface is spaced from the LED assembly and covers a larger portion of, or the entire, reflective surface 310, of the enclosure 302 where the reflective surface 300*a* reflects a larger percentage, or all, of the light emitted by the LEDs 127.

In the various embodiments described herein, the LED assembly is mounted on the LED tower in a manner that mimics the appearance of a traditional incandescent bulb. As a result, the LEDs can be positioned on the LED tower in the same area that the glowing filament is visible in a traditional incandescent bulb. As a result, the lamps of the invention provide similar optical light patterns to a traditional incandescent bulb and provide a similar physical appearance during use. The mounting of the LED assembly on the tower, such that the LEDs are centered on the longitudinal axis of the lamp and are in a position that is centrally located in the enclosure, provides the look of a traditional incandescent bulb. Centrally located means that the LEDs are disposed on the tower in the free open space of the enclosure as distinguished from being mounted at or on the bottom of the enclosure or on the enclosure walls. In certain embodiments, the LEDs are positioned in a band about the tower such that the high intensity area of light produced from the LEDs appears as a glowing filament of light when in use. The band of LEDs could be produced by single or multiple rows or strings of LEDs that are closely packed together within the band or offset from each other within the band. Various configurations are possible where the LEDs are positioned in a band or concentrated in a particular region about the LED tower to produce a filament-type appearance when in use and when viewed from different directions. In some embodiments, the LEDs may be arranged on the tower such that they are in a relatively narrow band that is located near the optical center of the enclosure. In some embodiments, the LEDs may be arranged on the filament tower in a narrow band that extends around the periphery of the tower where the height of the band (in the dimension along the axis of the tower) is smaller than the diameter of the tower. As a result, the when the lamp is viewed from the side the LEDs create a bright light source that that extends across the lamp and appears as a relatively bright line inside of the enclosure. In addition to extending around the periphery of the tower the LEDs also extend around or encircle the longitudinal axis of the lamp. In some embodiments, the tower is disposed along the longitudinal axis of the lamp such that the LEDs surround or extend around both the longitudinal axis of the lamp and the tower as shown in the Figures. In some embodiments the LEDs may be disposed such that the LEDs do not surround the tower but still surround the longitudinal axis of the lamp.

In some embodiments, depending on the LEDs used, the exit surfaces in these and other embodiments may be made of glass which has been doped with a rare earth compound, in this example, neodymium oxide. Such an optical element could also be made of a polymer, including an aromatic polymer such as an inherently UV stable polyester. The exit surface is transmissive of light. However, due to the neodymium oxide in the glass, light passing through the dome of the optical element is filtered so that the light exiting the dome exhibits a spectral notch. A spectral notch is a portion of the color spectrum where the light is attenuated, thus forming a "notch" when light intensity is plotted against wavelength. Depending on the type or composition of glass or other material used to form the optical element, the amount of neodymium compound present, and the amount and type of other trace substances in the optical element, the spectral notch can occur between the wavelengths of 520 nm and 605 nm. In some embodiments, the spectral notch can occur between the wavelengths of 565 nm and 600 nm. In other embodiments, the spectral notch can occur between the wavelengths of 570 nm and 595 nm. Such systems are disclosed in U.S. patent application Ser. No. 13/341,337, filed Dec. 30, 2011, titled "LED Lighting Using Spectral Notching" which is incorporated herein by reference in its entirety.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

at least one LED mounted on a submount operable to emit light through an at least partially optically transmissive enclosure when energized through an electrical path from a base, the submount comprising electrical conductors and a dielectric material, the electrical conductors forming at least one anode and at least one cathode for mounting the at least one LED and at least one first electrical contact pad to electrically couple the at least one LED to the electrical path;

a tower located within the enclosure and extending in an axial direction, the tower comprising an interior and an exterior in communication with one another through an aperture in the tower, wherein at least a first portion of the submount containing the at least one anode and at least one cathode is located on the exterior of the tower and a second portion of the submount containing the at least one first electrical contact pad extends through the aperture and into the interior of the tower; and electrical circuitry on aboard, the board extending into the interior of the tower, the submount being electrically coupled to the electrical circuitry at the at least one first electrical contact pad by an electrical coupling, the electrical coupling being in the interior of the tower and within the enclosure, where the electrical circuitry and the electrical conductors on the submount are in the electrical path.

2. The lamp of claim 1 wherein the base comprises an Edison screw.

3. The lamp of claim 1 wherein an extension extends from the base and comprises at least one second electrical contact that is electrically coupled to the at least one first electrical contact.

4. The lamp of claim 3 wherein one of the at least one first electrical contact and the at least one second electrical contact is biased into engagement with the other one of the at least one first electrical contact and the at least one second electrical contact.

5. The lamp of claim 4 wherein the one of the at least one first electrical contact and the at least one second electrical contact is resiliently deformable.

6. The lamp of claim 5 wherein the at least one first electrical contact and the at least one second electrical contact are located internally of the tower.

7. The lamp of claim 3 wherein the extension comprises a board where the board supports a lamp electronics in the base.

8. The lamp of claim 3 wherein the at least one second electrical contact is electrically coupled to a lamp electronics.

9. The lamp of claim 3 wherein the at least one first electrical contact and the at least one second electrical contact are electrically isolated in the tower from the external environment.

10. The lamp of claim 1 wherein the submount comprises one of a flex circuit, MCPCB and a lead frame.

11. The lamp of claim 1 wherein a plurality of LEDs are mounted on the first portion of the submount.

12. The lamp of claim 1 wherein the tower extends into the enclosure and supports the at least one LED at the optical center of the enclosure.

13. The lamp of claim 1 wherein a reflector reflects light from the at least one LED to an exit surface of the enclosure.

14. The lamp of claim 1 wherein the tower is thermally conductive and forms part of a heat sink for dissipating heat from the at least one LED.

15. The lamp of claim 14 wherein the heat sink comprises a heat dissipating portion that is at least partially exposed to the ambient environment.

16. A lamp comprising:

an at least partially optically transmissive enclosure having an opening;

a base;

a plurality of LEDs mounted on a submount, the submount comprising electrical conductors and a dielectric material, the electrical conductors forming at least one anode and at least one cathode for mounting the at least one LED on a first portion of the submount and a first electrical contact pad on a second portion of the submount to electrically couple the at least one LED to the electrical path, the plurality of LEDs being located in the enclosure and operable to emit light when energized through an electrical path from the base;

a heat sink secured to the enclosure at the opening comprising a heat dissipating portion that is at least partially exposed to the ambient environment and a heat conducting portion that comprising a tower that extends from the opening toward the interior of the enclosure and is located within the enclosure and is thermally coupled to the plurality of LEDs, the tower comprising an interior and an outside surface and an aperture extending from the interior and the outside surface, wherein the first portion of the submount is mounted on the outside surface of the heat conducting portion and the second portion of the submount extends through the aperture and into the interior, electrical circuitry extending from the base into the interior of the tower, the first electrical contact pad on the second portion of the submount being connected to the electrical circuitry within the interior.

17. The lamp of claim 16 comprising wherein an extension electrically coupled to the base comprising a second electrical contact that is directly electrically coupled to the first electrical contact.

18. The lamp of claim 17 wherein one of the first electrical contact and the second electrical contact is biased into engagement with the other one of the first electrical contact and the second electrical contact.

19. The lamp of claim 17 wherein the one of the first electrical contact and the second electrical contact is resiliently deformable.

20. The lamp of claim 16 wherein a reflector reflects light from the plurality of LEDs to an exit surface of the enclosure.

21. The lamp of claim 20 wherein the reflector comprises a reflective surface that surrounds a portion of the heat sink.

22. The lamp of claim 16 wherein the heat sink is disposed between the enclosure and the base.

23. The lamp of claim 16 wherein the base comprises an Edison screw.

24. The lamp of claim 16 wherein the plurality of LEDs are disposed about the periphery of the heat sink in a band and face outwardly toward the enclosure to create a source of the light that appears as a glowing filament.

25. A lamp comprising:

an at least partially optically transmissive enclosure having an open end and a base defining a longitudinal axis of the lamp extending from the base to the enclosure;

a flex circuit comprising an electrical conductor and a layer of dielectric material a plurality of LEDs connected to the electrical conductor, the plurality of LEDs being operable to emit light when energized through an electrical path from the base;

a heat sink secured to the open end and comprises a heat dissipating portion that is at least partially exposed to the ambient environment and a heat conducting portion that forms a tower that extends into the enclosure and has an outer periphery facing radially away from the longitudinal axis and an interior, the flex circuit mounted around the outer periphery of the tower such that the plurality of LEDs are disposed in approximately the center of the enclosure along the longitudinal axis of the lamp;

a first electrical contact extending from the base and a second electrical contact pad formed from the electrical conductor of the flex circuit and extending from the outer periphery into the interior of the heat conducting portion, the first electrical contact and the second electrical contact pad biased into engagement to create an electrical coupling with one another, the electrical coupling being electrically isolated inside of the heat conducting portion and in the enclosure.

* * * * *